United States Patent [19]

Masuda et al.

[11] Patent Number: 4,840,322

[45] Date of Patent: Jun. 20, 1989

[54] WINDING OF FLEXIBLE ELONGATE MATERIAL

[75] Inventors: Yuichi Masuda, Namerikawa; Kozo Shimizu, Kurobe, both of Japan

[73] Assignee: Yoshida Kogyo K.K., Tokyo, Japan

[21] Appl. No.: 159,928

[22] Filed: Feb. 24, 1988

Related U.S. Application Data

[62] Division of Ser. No. 859,490, May 5, 1986, Pat. No. 4,742,969.

[30] Foreign Application Priority Data

May 17, 1985 [JP] Japan ..... 60-105576

[51] Int. Cl.[4] ..... B65H 18/10

[52] U.S. Cl. ..... 242/67.1 R; 242/74

[58] Field of Search ..... 242/67.1 R, 74, 74.1, 242/71.8, 68.4

[56] References Cited

U.S. PATENT DOCUMENTS

| | | | |
|---|---|---|---|
| 1,736,463 | 11/1929 | Rodger | 242/74 |
| 2,180,829 | 11/1939 | Kolmodin | 242/71.8 X |
| 3,853,281 | 12/1974 | Elliott | 242/74 |
| 4,365,768 | 12/1982 | Woodruff | 242/68.4 X |

*Primary Examiner*—David Werner

[57] ABSTRACT

A spool for winding thereon a flexible elongate material includes a hollow cylindrical body having an elongate radial opening defined axially in the annular peripheral wall of the spool body for providing a passage of a holding means for automatically holding a leading end of the elongate material on the spool body. A winding apparatus includes a pair of oppositely disposed first and second drive shafts for holding the spool therebetween. The holding means is associated with the first drive shaft and cooperative with the radial opening in the spool body in effecting the holding of the leading end. The holding means is either the pneumatic type or the mechanical type. The pneumatic holder means produces a negative pressure in the axial hole in the spool body to create a suction force acting around the radial opening in the spool body. Due to the negative pressure thus produced, the leading end of the elongate material is sucked toward the radial opening and then adhered to the annular wall of the spool body. The mechanical holding means includes a row of locking needles movably mounted in an end portion of the first drive shaft so as to selectively project outwardly beyond the annular wall through the radial opening of the spool body.

7 Claims, 7 Drawing Sheets

WINDING OF FLEXIBLE ELONGATE MATERIAL

This is a division of application Ser. No. 859,490, filed May 5, 1986 now U.S. Pat. No. 4,742,969.

BACKGROUND OF THE INVENTION

1. Field of the Invention

The present invention relates generally to the winding of flexible elongate materials, such as slide fastener stringer tapes, slide fastener chains, surface-type fasteners known as hook-and-loop fasteners, belts for garments, and ornamental tapes. More particularly, it relates to a spool for winding thereon a flexible elongate material and also to a method and apparatus for winding a flexible elongate material on such spool.

2. Prior Art

There are known various winding methods and apparatus which comprise a spool for winding thereon a flexible elongate material, the spool being in the form of a cylindrical rod with or without a flange at either end thereof. The known spools have a smooth material-bearing peripheral surface and some of them include a resilient clip generally constituted by a leaf spring, extending axially of the spool and urged against the peripheral surface to hold a leading end of the flexible elongate material.

Winding a flexible elongate material on such known spool needs a manual operation to hold a leading end of the flexible elongate material either by an adhesive or by the clip before the spool is revolved. This manual operation is tedious and time-consuming, thereby lowering the winding efficiency. Furthermore, such manual holding operation can hardly be effected when a relatively narrow elongate material is to be wound on a spool having opposed annular end flanges of a diameter which is considerably large in relation to the distance between the annular end flanges. With the known spool thus constructed, an automated winding of the flexible elongate material is difficult to achieve.

SUMMARY OF THE INVENTION

It is accordingly an object of the present invention to provide a spool for winding thereon a flexible elongate material, the spool having structural features which enable a leading end of the elongate material to be held on the spool without the necessity of tedious and time-consuming manual operation.

Another object of the present invention is to provide a method and apparatus for automatically winding a flexible elongate material on such spool.

According to the present invention, a spool for winding thereon a flexible elongate material includes a hollow cylindrical body having an elongate radial opening defined axially in the annular peripheral wall of the spool body for providing a passage of a holding means for automatically holding a leading end of the elongate material on the spool body. A winding apparatus includes a pair of oppositely disposed first and second drive shafts for holding the spool therebetween. The holding means is associated with the first drive shaft and cooperative with the radial opening in the spool body in effecting the holding of the leading end. The holding means is either the pneumatic type or the mechanical type. The pneumatic holder means produces a negative pressure in the axial hole in the spool body to create a suction force acting around the radial opening in the spool body. Due to the negative pressure thus produced, the leading end of the elongate material is sucked toward the radial opening and then adhered to the annular wall of the spool body. The mechanical holding means includes a row of locking needles movably mounted in an end portion of the first drive shaft so as to selectively project outwardly beyond the annular wall through the radial opening of the spool body. With this construction, the leading end of the elongate material is automatically be held on the spool body without the necessity of tedious and time-consuming manual operation.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
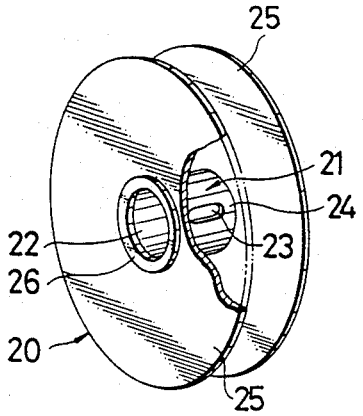
FIG. 1 is a perspective view, with parts cut away for clarity, of a spool embodying the present invention.
Figure 2:
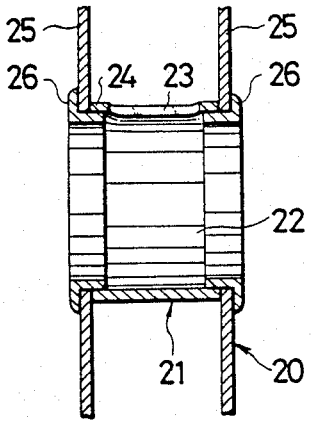
FIG. 2 is an enlarged fragmentary axial cross-sectional view of the spool shown in FIG. 1.

As shown in FIG. 1, a spool 20 comprises a hollow cylindrical body 21 having an axial hole 22 extending therethrough, and an elongate radial opening 23 defined in an annular peripheral wall 24 of the spool body 21 and communicating with the axial hole 22. The spool body 21 further has, at its opposite ends, a pair of annular flanges 25, 25 projecting radially outwardly from the annular peripheral wall 24, and a pair of annular hubs 26, 26 fitted in the axial hole 22. As shown in FIG. 2, the elongate radial opening 23 extends axially in the annular peripheral wall 24 with its opposite ends terminating short of the annular flanges 25. The annular flanges 25 serve as an edge-guide means for guiding opposite longitudinal edges of a flexible elongate material, for example, a slide fastener stringer tape, while the latter is being wound on the spool 20. The annular flanges 25 further serves to prevent the flexible elongate material held thereon from being displaced off the spool 20 which would otherwise occurred when an axial force is exerted on the elongate material.

Figure 4:
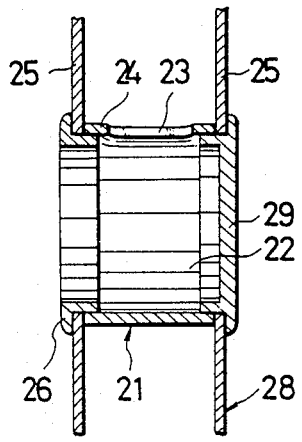
FIG. 4 is a view similar to FIG. 2, showing a modified spool.

FIG. 4 shows a modified spool 28 which is substantially identical with the spool 20 of FIG. 1, with the exception that one end of the hollow cylindrical body 21 is closed by a circular bush 29 fitted in the axial hole 22 in the spool body 21.

Figure 5:
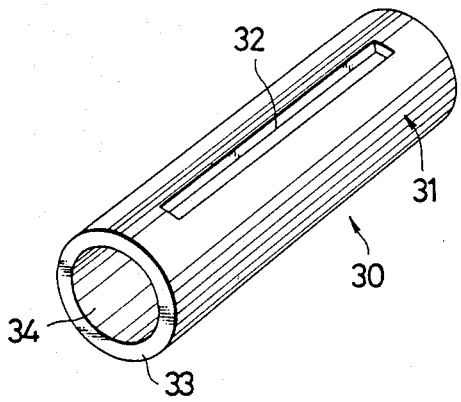
FIG. 5 is an enlarged perspective view of another spool suitable for winding thereon a flexible elongate material of a relatively large width.

Another modified spool 30 shown in FIG. 5 is particularly suitable for use in winding an elongate material having a relatively large width. The spool 30 comprises an elongate hollow cylindrical body 31 free of a flange at either end thereof. The spool body 31 has an elongate opening 32 extending axially in an annular peripheral wall 33 of the spool body 31, the opening 32 communicating with an axial hole 34 defined by the annular peripheral wall 33. The axial hole 34 may be a blind hole with its one end closed. The elongate opening 32 has its opposite ends located near the opposite ends of the spool body.

Figure 3:
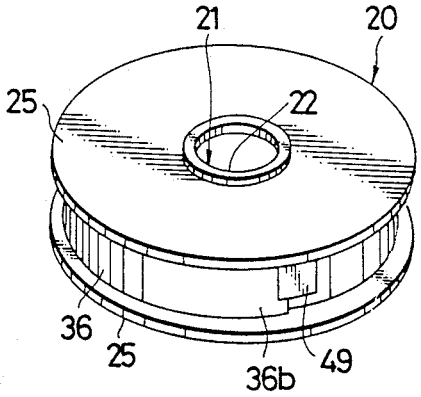
FIG. 3 is a perspective view of the spool with an elongated material wound thereon.
Figure 6:
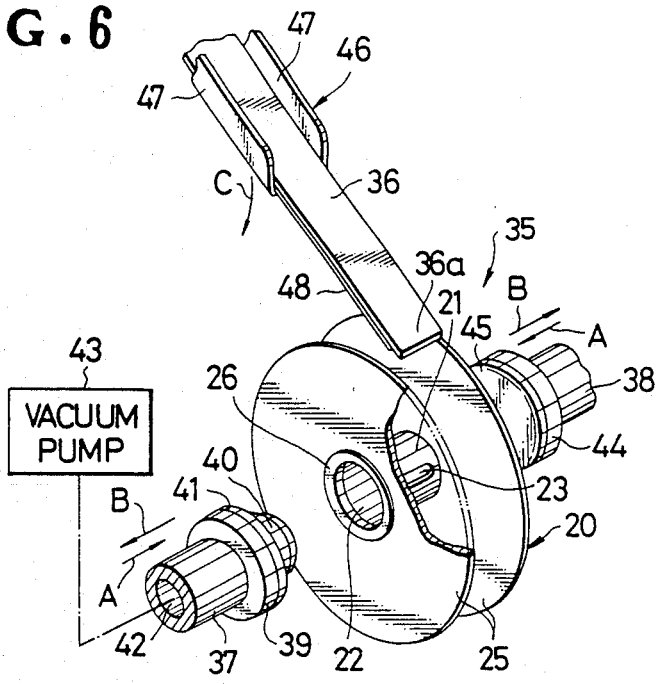
FIG. 6 is a fragmentary perspective view of an apparatus for winding a flexible elongate material according to the present invention, the apparatus employing the spool shown in FIG. 1.

FIG. 6 shows an apparatus 35 for winding a flexible elongate material 36, the apparatus 35 employing the spool 20 shown in FIGS. 1–3.

The winding apparatus 35 includes a pair of first and second drive shafts 37, 38 rotatably supported on a frame (not shown) of the apparatus 35 in axial alignment with each other, the first and second drive shaft 37, 38 being reciprocably movable toward and away from one another in the directions indicated by the arrows A and B.

Figure 7:
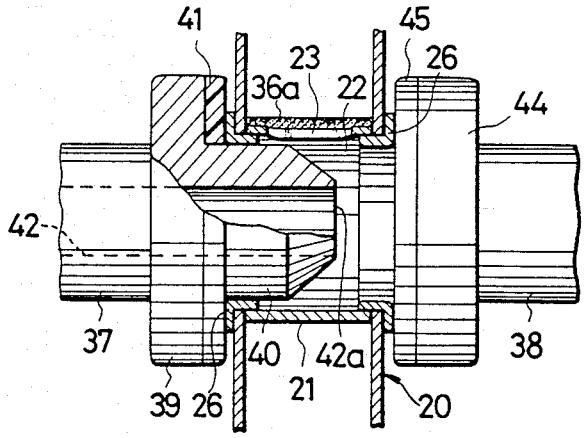
FIG. 7 is an enlarged fragmentary side elevational view, partly in cross section, of the apparatus shown in FIG. 6, the view showing the spool held between a pair of opposed drive shafts.
Figure 8:
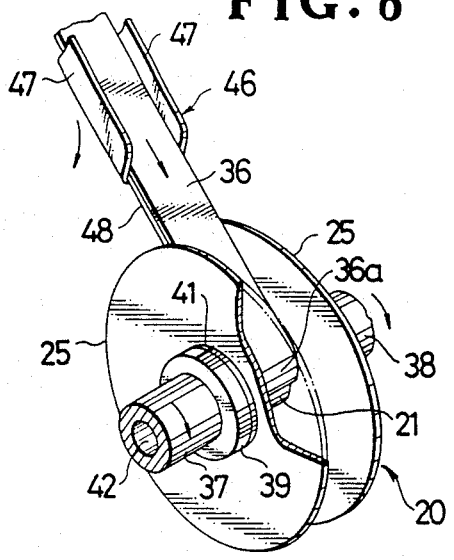
FIG. 8 is a view similar to FIG. 6, illustrating the manner in which a leading end of the flexible elongate material is held on the spool.

The first drive shaft 37 includes at its one end an annular flange 39 and a cylindrical extension 40 projecting coaxially from the annular flange 39. The cylindrical extension 40 has an outside diameter which is slightly smaller than the inside diameter of the annular hub 26 of the spool 20 so that, as shown in FIG. 7, the extension 40 is receivable in the axial hole 22 of the spool 20 when the latter is held by and between the first and second drive shafts 37, 38. An elastic seal-and-friction ring 41 of soft synthetic rubber is fitted around the cylindrical extension 40 and secured by adhesive bonding to one end face of the annular flange 39. The first drive shaft 37 has an axial suction hole or passageway 42 extending therethrough and having one end or an inlet 42*a* (FIG. 7) adapted to open to the axial hole 22 in the spool 20, the other end of the suction passageway 42 being connected to a suitable vacuum source such as a vacuum pump 43. Although not shown, the other end of the first drive shaft 37 is connected in driven relation to a suitable drive means in such a manner that the first drive shaft 37 effects reciprocating and rotary motions upon operation of the drive means.

The second drive shaft 38 includes an enlarged circular end plate 44 connected at one end thereof, and an elastic seal-and-friction disc 45 of soft synthetic rubber secured by adhesive bonding to an end face of the end plate in confronting relation to the first drive shaft 37. The second drive shaft 38 is coupled with a suitable drive means (not shown) and driven by the latter to positively rotate in synchronism with the rotation of the first shaft 37 and also to reciprocate toward and away from the first drive shaft 37. Alternatively, the second shaft 38 may be freely rotatably journaled on the frame of the apparatus 35.

The winding apparatus 35 also includes a guide means 46 for guiding the flexible elongate material 36 while the latter is being fed toward the apparatus 35 by means of a suitable feed means (not shown). The guide means 46 comprises a trough-like guide member extending toward the spool body 21 in perpendicular relation to the axis of the same. The trough-like guide member 46 includes a pair of opposed sidewalls 47, 47 extending along the length thereof except its one end portion 48. The one end portion 48 is normally held above the spool body 21 and the other end of the guide member 46 is pivoted on the frame of the apparatus 35. The end portion 48, from which the sidewalls 47, 47 are removed, has a width smaller than the distance between the annular flanges 25 of the spool 20 so that the end portion 48 is receivable between the flanges 25 when the guide member 46 is turned about its pivoted end to move downwardly toward the spool 20.

The winding apparatus 35 thus constructed operates as follow. While the spool 20 is held between the first and second shafts 37, 38 in axially spaced relation thereto, the first and second drive shafts 37, 38 are actuated to move axially in the directions indicated by the arrows A, A in FIG. 6. This movement of the shafts 37, 38 causes the spool 20 to be firmly gripped by and between the first and second shafts 37, 38 with the cylindrical extension 40 received in the axial hole 22 in the spool 20. In this instance, the elastic ring 41 and the elastic disc 45 are forced against the mating hubs 26, 26 to provide a pair of fluid-tight seals respectively therebetween. Due to the friction acting between the elastic ring 41 and the hub 26 and between the elastic disc 45 and the hub 26, the spool 20 is rotatable in unison with the first and second drive shafts 37, 38.

Then the vacuum pump 43 is started to exhaust air from the axial hole 22 of the spool 20 through the suction passageway 42, thereby creating a partial vacuum in the axial hole 22. Due to the vacuum thus created, the external atmospheric pressure forces the surrounding air into the axial hole 20 through the radial opening 23 of the spool 20. This airflow also produces a vacuum over an outer surface of the annular peripheral wall 24 in the vicinity of the radial opening 23.

Thereafter, the flexible elongate material 36 is fed longitudinally along the guide member 46 toward the spool 20. At the same time, the guide member 46 is actuated to turn clockwise in the direction indicated by the arrow C in FIG. 6 until its end portion 48 is disposed immediately above the annular peripheral wall 24 of the spool body 21. As the elongate material 36 further advances, its leading end 36*a* overlies the radial opening 23 whereupon the leading end 36*a* is sucked toward the radial opening 23 and then adhered to the outer surface of the annular peripheral wall 24, due to the vacuum or negative pressure created in the vicinity of the radial opening 23 and in the axial hole 22 of the spool 20. Then the first and second drive shafts 37, 38 are driven to rotate the spool 20, thereby winding the elongate material 36 on the spool 20. Upon completion of the winding, the first and second drive shafts 37, 38 are stopped and a trailing end 36*b* (FIG. 3) of the elongate material 36 thus wound is locked in position against unwinding by means of an adhesive tape 39. The first and second drive shafts 37, 38 are moved in the directions indicated by the arrows B in FIG. 6 to release the spool 20. At the same time the operation of vacuum pump 43 is stopped. Alternatively, the operation of the vacuum pump 43 may be stopped after first several turns of the elongate material 36 have been wound on the spool 20 with the leading end 36 firmly held on the spool 20.

Figure 9:
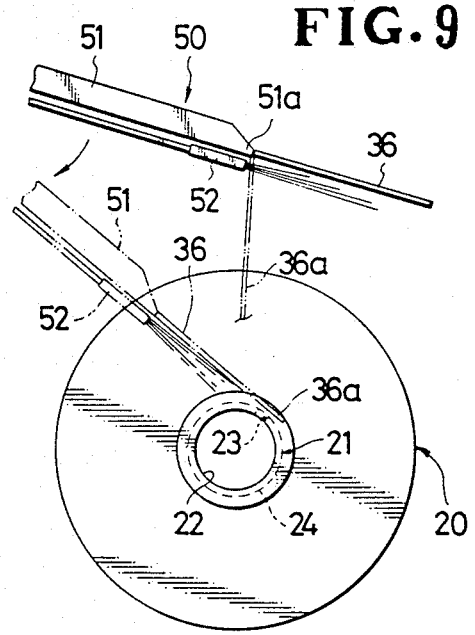
FIG. 9 is an enlarged front elevational view showing a modified guide means for guiding the leading end of a flexible elongate material to the spool.

FIG. 9 shows a modified guide member 50 having a pneumatic means for guiding the leading end 36*a* of an elongate material 36 to the spool body 21. The guide means 50 comprises a trough-like guide member 51 extending toward the spool 20 for guiding therealong a flexible elongate material 36, and an air nozzle 52 disposed immediately below a forward end 51*a* of the guide member 51. The air nozzle 52 produces a stream of air extending forwardly from the forward end 51*a* of the guide member 51 so that a leading end 36*a* of the elongate material 36 is supported on the thus produced airstream. The guide member 51 is pivoted at its rear end and pivotably movable between an upper position indicated by the solid lines in FIG. 9 and a lower position indicated by the phantom lines in the same figure. While the guide member 51 is held in its lower position, the leading end 36*a* of the elongate material 36 is guided to the annular peripheral wall 24 of the spool body 21 by means of the airstream ejected from the air nozzle 52. The leading end 36 thus guided is then adhered to the peripheral wall 24 due to a vacuum created in the axial hole 22 of the spool body 21.

Figure 10:
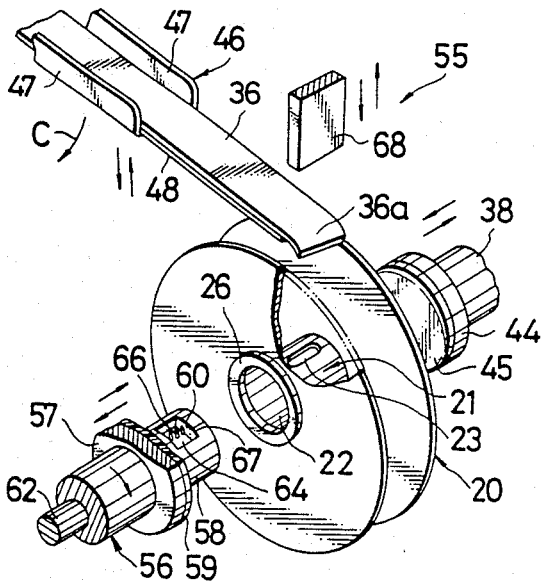
FIG. 10 is a view similar to FIG. 6, showing a modified winding apparatus according to the invention, the apparatus employing the spool shown in FIG. 1.

A modified winding apparatus 55 shown in FIG. 10 is substantially identical with the apparatus 35 shown in FIG. 6 with the exception that in place of the pneumatic holding means of the apparatus 35, the apparatus 55 includes a mechanical holding means for holding the leading end of a flexible elongate material, the mechanical holding means being associated with a first drive shaft 56. Other structural components are identical with those of the apparatus 35 so that they are indicated by the same reference numerals as those of the apparatus 35.

The first drive shaft 56 is rotatably mounted on a frame (not shown) of the apparatus 55 and coupled with a suitable drive means for rotary and reciprocating motions. The first shaft 56 includes at its one end an annular flange 57 and a cylindrical extension 58 projecting coaxially from the flange 57. The cylindrical extension 58 has an outside diameter slightly smaller than the inside diameter of the hub 26 of the spool 20 so that the extension 58 is receivable in the axial hole 22 of the spool body 21 as the first and second drive shafts 56, 38 are moved toward each other to grip the spool 20 therebetween. The first drive shaft 56 also includes an elastic friction ring 59 of soft synthetic rubber fitted around the cylindrical extension 58 and adhered to one end face of the annular flange 57.

Figure 11:
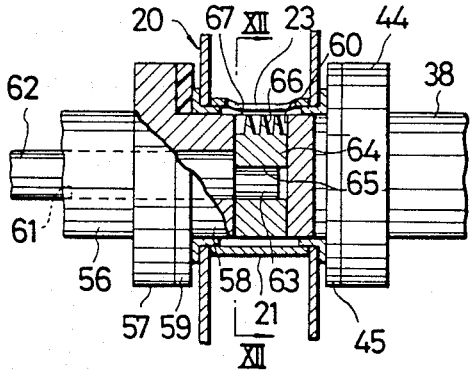
FIG. 11 is an enlarged fragmentary side elevational view of the apparatus shown in FIG. 10, the view illustrating locking needles in retracted position.
Figure 12:
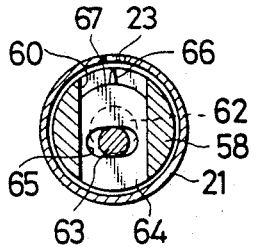
FIG. 12 is a cross-sectional view taken along line XII—XII of FIG. 10.

As shown in FIG. 11, the cylindrical extension 58 has a radial recess 60 extending diametrically therethrough and communicating with a central axial hole 61 defined in the first drive shaft 56. An auxiliary drive shaft 62 is rotatably received in the axial hole 61 and coupled at its one end with a suitable drive means (not shown) to rotate about its own axis. The other end of the auxiliary drive shaft 62 has an integral eccentric pin 63 projecting into the radial recess 60. A slider 64 is slidably received in the radial recess 60 and includes an oblong hole 65 in which the eccentric pin 63 of the auxiliary drive shaft 62 is movably received, the oblong hole 65, as shown in FIG. 12, extending perpendicularly to the axis of the radial recess 60. With this construction, the slider 64 is reciprocably movable in response to the rotation of the auxiliary drive shaft 62.

The slider 64 also includes a plurality of locking needles 66 projecting from one of the opposite end faces of the slider 64 and disposed along the axis of the cylindrical extension 58. The end faces of the slider 64 are arcuate and have the same radius of curvature as a peripheral surface of the cylindrical extension 58. The slider 64 has a height (the distance between tip ends of the locking needles 66 and the vertex of the other arcuate end face of the slider 64) which is substantially the same as or slightly smaller than the distance of the cylindrical extension 58. The eccentricity of the eccentric pin 63, i.e. the distance between the center of the eccentric pin 63 and the axis of the auxiliary drive shaft 62 is so set as to enable the slider 64 to move reciprocate between a retracted position shown in FIGS. 11 and 12 in which the slider 64 including its locking needles 66 is fully received in the radial recess 60 with the lower arcuate end face extending in flush with the peripheral surface of the cylindrical extension 58, and a locking position shown in FIG. 13 in which the locking needles 66 project outwardly from an upper end 63 of the radial recess 60 with the upper arcuate end face of the slider 64 extending in flush with the peripheral surface of the cylindrical extension 58. In the locking position shown in FIG. 13, the locking needles 66 also project through the radial opening 23 outwardly beyond the peripheral surface of the annular wall 24 of the spool body 21.

Figure 13:
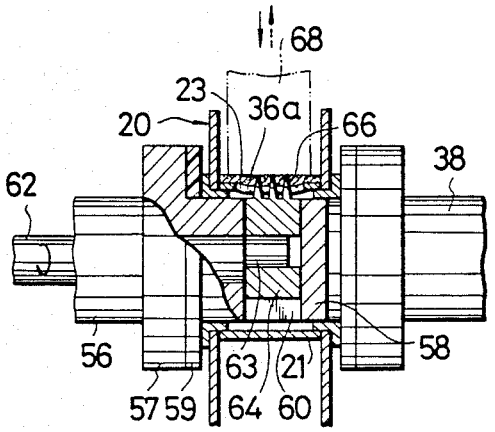
FIG. 13 is a view similar to FIG. 11, showing the locking needles in locking position.

The winding apparatus 55 also includes a presser pad 68 disposed in registry with the locking needles 66 and reciprocably movable toward and away from the latter to force the leading end 36*a* of the flexible elongate material 36 into interlocking engagement with the locking needles 36 while the latter is held in the locking position of FIG. 13.

The winding apparatus 55 operates as follows. The spool 20 is disposed between the first and second drive shafts 56, 38 with its radial opening 23 held in axial alignment with the locking needles 66 on the first shaft 56. In this instance, the locking needles 66 are fully retracted in the radial recess 60 in the cylindrical extension 58 of the first drive shaft 56. Then the first and second drive shafts 56, 38 are moved toward each other to firmly grip the spool 20 therebetween, as shown in FIG. 11 in which the locking needles 66 are disposed in registry with the radial opening 23 in the spool body 21. The auxiliary drive shaft 62 is turned through an angle of 180° to move the slider 64 in its upper locking position where the locking needles 66 project outwardly from the radial opening 23 of the spool 20.

Subsequently, an elongate material 36 is fed along the guide member 47 (FIG. 10) toward the spool 20. In synchronism therewith, the guide member 47 is actuated to turn in the direction indicated by the arrow C so that a leading end 36*a* of the elongate material 36 is guided by the end portion 48 of the guide member 46 to extend over the radial opening 23 of the spool 20. Then the pressure pad 68 is actuated to move downwardly toward the locking needles 66, thereby locking the leading end 36*a* of the elongate material 36 on the locking needles 66. The first and second drive shafts 56, 38 are driven to rotate the spool 20, thereby winding the elongate material 36 on the spool 20. After the elongate material 36 has fully been wound on the spool 20, the auxiliary drive shaft 62 is turned through an angle of 180° to retract the locking needles 66 into the radial recess 60 in the cylindrical extension 58. Then the first and second drive shafts 56, 38 are moved away from each other to release the spool 20. It is possible to move the locking needles 66 to its retracted position after first several turns of the elongate material 36 have been wound on the spool 20.

Figure 14:
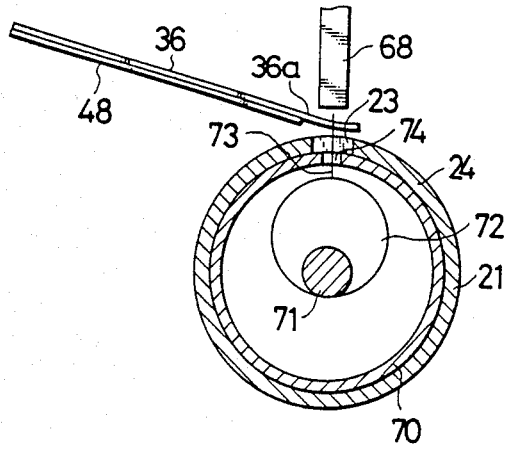
FIGS. 14 and 15 are enlarged schematic cross-sectional views of a modified winding apparatus illustrating different operating steps of resilient locking needles.
Figure 15:
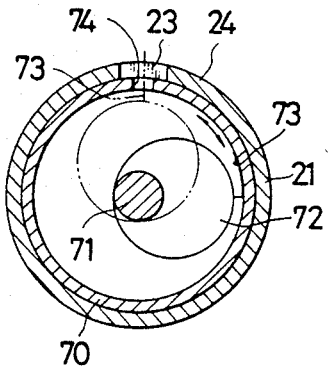

FIGS. 14 and 15 shows a modified locking mechanism for releasably locking the leading end 36a of a flexible elongate material 36. The locking mechanism comprises a hollow cylindrical main drive shaft 70 having an end portion receivable in the axial hole of the spool 20, and an auxiliary drive shaft 71 rotatably received in the hollow cylindrical main drive shaft 70 in concentric relation therewith. The auxiliary drive shaft 71 supports thereon an eccentric disc 72 carrying, on its peripheral surface, a row of resilient locking needles 73 (only one shown). In response to the rotary motion of the auxiliary drive shaft 71 and hence of the eccentric disc 72, the resilient locking needles 73 move between the locking presition of FIG. 14 in which the needles 73 project outwardly beyond the outer periphery of the annular wall 24 of the spool body 21, through an elongate radial recess 74 in the main drive shaft 70 and through the radial opening 23 in the annular wall 24, and the retracted position of FIG. 15 in which the locking needles 73 are resiliently deformed along an inner peripheral surface of the hollow main drive shaft 70.

Although various minor modifications may be suggested by those versed in the art, it should be understood that we wish to embody within the scope of the patent warranted hereon, all such embodiments as reasonably and properly come within the scope of our contribution to the art.

What is claimed is;

1. A method of winding an elongate material, comprising the steps of:

(a) rotatably holding a spool from its opposite ends by and between a pair of oppositively disposed first and second drive shafts, the spool including a hollow cylindrical body having an axial hole extending from one end thereof and defined by an annular peripheral wall of the spool body, and a radial opening extending through the annular peripheral wall and communicating with the axial hole, the first drive shaft having an end received in the axial hole in the spool body and movably supporting thereon at least one locking needle, the locking needle being selectively projectable beyond a peripheral surface of the annular wall of the spool body through the radial opening;

(b) projecting the locking needle outwardly beyond the peripheral surface of the annular wall;

(c) locking a leading end of the flexible elongate material on the locking needle; and (d) winding the elongate material on the spool by rotating the first and second drive shafts.

2. A method according to claim 1, said locking step (c) terminating after first several turns of the elongate material have been wound on the spool.

3. An apparatus for winding a flexible elongate material, comprising:

(a) a spool for winding thereon the flexible elongate material, including a hollow cylindrical body having an axial hole extending from end thereof and defined by an annular peripheral wall of said spool body, and a radial opening extending through said annular peripheral wall and communicating with said axial hole;

(b) a pair of oppositively disposed first and second drive shafts relatively movable toward and away from each other for releasably holding said spool, said first and second drive shafts being rotatable about their own axes to revolve said spool, said first drive shaft having at its one end an annular flange engageable with said one end of said spool body and an extension projection from said annular flange that is receivable in said axial hole in said spool body, said extension of said first drive shaft having a radial recess disposed in registry with said radial opening in said spool body; and (c) holding means associated with said first drive shaft and cooperative with said radial opening with said spool body for holding a leading end of the flexible elongate material on said spool body, said holding means including an axial hole in said first drive shaft communicating at its one end with said radial recess, said holding means further comprising an auxiliary drive shaft rotatably received in said axial hole and said first drive shaft, at least one locking needle operatively connected with said auxiliary drive shaft and selectively projectable beyond an outer peripheral surface of said annular peripheral wall, through said radial recess in said extension and through said radial opening in said spool body, and a presser pad disposed in registry with said radial opening of said spool body and reciprocably movable toward said spool body to force the leading end of the elongate material into locking engagement with said locking needle when the latter projects beyond said outer peripheral surface of said annular wall.

4. An apparatus according to claim 3, said radial recess extending diametrically through said extension, said holding means further including a slider slidably received in said radial recess, said slider having opposite end faces facing to the opposite ends of said radial recess, and an oblong hole extending perpendicular to the axis of said radial recess, said locking needle being disposed on one of said end faces of said slider, said auxiliary drive shaft having an eccentric pin movably received in said oblong hole.

5. An apparatus according to claim 4, said first drive shaft further including an elastic friction ring disposed around said extending and frictionally engageable with said one end of said spool body.

6. An apparatus according to claim 4, said extension having a cylindrical shape, said end faces of said slider being arcuate and having the same radius of curvature as a peripheral surface of said cylindrical extension.

7. An apparatus according to claim 3, said auxiliary drive shaft including an eccentric disc movably disposed in said axial hole in said first drive shaft, said locking needle being resilient and disposed on a peripheral surface of said eccentric disc.

* * * * *